US005765391A

United States Patent [19]

Lee et al.

[11] Patent Number: 5,765,391

[45] Date of Patent: Jun. 16, 1998

[54] REFRIGERANT CIRCULATION APPARATUS UTILIZING TWO EVAPORATORS OPERATING AT DIFFERENT EVAPORATING TEMPERATURES

[75] Inventors: Myung Ryul Lee; Gye Young Song, both of Kyungki-Do, Rep. of Korea

[73] Assignee: LG Electronics Inc., Rep. of Korea

[21] Appl. No.: 744,173

[22] Filed: Nov. 5, 1996

[30] Foreign Application Priority Data

Nov. 14, 1995 [KR] Rep. of Korea ..... 41156/1995

[51] Int. Cl.[6] ..... F25B 41/00

[52] U.S. Cl. ..... 62/442; 62/513

[58] Field of Search ..... 62/513, 442, 200

[56] References Cited

U.S. PATENT DOCUMENTS

| | | | |
|---|---|---|---|
| 2,479,733 | 8/1949 | Dodson | 62/200 |
| 2,719,407 | 10/1955 | Zearfoss, Jr. | 62/513 |
| 2,781,646 | 2/1957 | Buchanan | 62/513 |
| 2,801,523 | 8/1957 | Hansen | 62/513 |
| 3,218,819 | 11/1965 | Crotser | 62/442 |
| 4,702,086 | 10/1987 | Nunn, Sr. et al. | 62/513 |
| 5,406,805 | 4/1995 | Radermacher et al. | 62/513 |
| 5,479,789 | 1/1996 | Borten et al. | 62/513 |

*Primary Examiner*—William E. Tapoical

*Attorney, Agent, or Firm*—Ostrolenk, Faber, Gerb & Soffen, LLP

[57] ABSTRACT

A refrigerant circulation apparatus utilizing two evaporators operating at respectively different evaporating temperatures which is capable of efficient refrigerant circulation by performing a heat exchange by contact between a refrigerant pipe guiding refrigerant discharged from a condenser to an evaporator and a refrigerant pipe guiding refrigerant discharged from the evaporator to a compressor in order to enhance the refrigerating ability when an evaporator is operated at a high evaporating temperature and pressure, includes a compressor, a condenser, a plurality of evaporators operating at different respective evaporating temperatures, a first plurality of refrigerant pipes for guiding the refrigerant discharged from the condenser to the plurality of evaporators, and a second plurality of refrigerant pipes predetermined portions of which are in heat exchanging contact with the first plurality of refrigerant pipes.

3 Claims, 2 Drawing Sheets

REFRIGERANT CIRCULATION APPARATUS UTILIZING TWO EVAPORATORS OPERATING AT DIFFERENT EVAPORATING TEMPERATURES

BACKGROUND OF THE INVENTION

1. Field of the Invention

The present invention relates to a refrigerant circulation apparatus utilizing two evaporators, and more particularly, to an improved refrigerant circulation apparatus in which two evaporators utilizing different evaporating temperatures are employed which is capable of the efficient refrigerant circulation without changing the size of an evaporator and a condenser.

2. Description of the Prior Art

A general refrigerant circulation apparatus, as shown in FIG. 1, includes a compressor 1, a condenser 2, a capillary 3, and an evaporator 4.

The compressor 1 changes a low temperature and pressure gas refrigerant to a high temperature and pressure gas refrigerant. The condenser 2, located at one side of the compressor 1, changes the high temperature and pressure gas refrigerant discharged from the compressor 1 to a high temperature and pressure liquid refrigerant.

At one side of the condenser 2 is provided the capillary 3 for changing the high temperature and pressure liquid refrigerant discharged from the condenser 2 to a low temperature and pressure liquid refrigerant.

Between the compressor 1 and the capillary is provided the evaporator 4 by which refrigeration is achieved by changing the low temperature and pressure liquid refrigerant to a low temperature and pressure gas refrigerant by evaporation to take in exterior heat.

A drier 5 is disposed between the capillary 3 and the condenser 2.

In the general refrigerant circulation apparatus employing the above structure, the refrigerant discharged from the compressor 1 is changed to a liquid refrigerant while passing through the condenser 2 to give off heat.

While passing through the evaporator 4, the liquid refrigerant is changed to a gaseous condition to absorb exterior heat, by which cooling and heating are performed.

A refrigerator can be taken as an example to which the refrigerant circulation apparatus is applied, and the refrigerator maintains an interior temperature thereof to be cool by having an evaporator provided therein.

Here, the refrigerator may have one evaporator or more than one evaporator.

In case of the latter, that is, in the refrigerant circulation apparatus in which two evaporators are provided to maintain appropriately different temperatures in a freezing chamber and a refrigerating chamber, respectively, evaporators 4 having different evaporating temperatures are disposed in the freezing chamber and the refrigerating chamber, respectively, and the two evaporators 4 are connected to the compressor 1 and the condenser 2 to form the refrigerant circulation apparatus.

Therefore, refrigerant discharged from the compressor 1 to be sent to the condenser 2 passes through the capillary 3, and is selectively supplied to the two evaporators 4 mounted in the freezing chamber and the refrigerating chamber by controlling a solenoid valve (not illustrated).

Here, in a refrigerating cycle utilizing a plurality of evaporators 4, a refrigerant is sequentially supplied to the evaporators 4, and an optimum energy efficiency is maintained when the evaporators in the freezing chamber and the refrigerating chamber are operated at an evaporative pressure of 0.07–0.146 $Kg/Cm^2$ and 1.27–1.55 $Kg/Cm^2$, respectively.

However, in the above-described conventional refrigerant circulation apparatus, since the refrigerating ability of the evaporator 4 having a high evaporating temperature and pressure and provided in the refrigerating chamber is less than that of the evaporator 4 having a low evaporating temperature and pressure and provided in the freezing chamber, the size of the evaporator 4 disposed in the refrigerating chamber must be increased to perform a sufficient heat exchange. However, the size of the refrigerator cannot be increased without a limit according to the size of the evaporator 4, and when the conventional small-sized evaporator 4 is adopted, consequently the efficiency cannot be improved.

Further, the size of the condenser 2 must be increased since the heat exchange required for condensation must be increased if the refrigerating ability is to be increased when the evaporator 4 having the high evaporating temperature and pressure is operated, but if the heat exchange required for condensation cannot be increased due to the size limit, since the condensing pressure and temperature are increased, the efficiency of the refrigerator cannot be improved by as much as the pressure of the compressor 1 is increased.

Table 1 shows a comparison between the refrigerating ability of the refrigerator when it is operated at an evaporating temperature of −28° C. and that of the refrigerator when it is operated at an evaporating temperature of −15° C.

TABLE 1

| TCE (°C.) | OPC | RFR (Kg/h) | RA (Kcal/h) | HRC (Kcal/h) |
|---|---|---|---|---|
| 40/−28 | 1.05 | 4.08 | 126.6 | 253.5 |
| 40/−15 | 1.46 | 7.91 | 238.9 | 414.1 |

*TCE: temperature for condensation and evaporation
OPC: outlet pressure of compressor
RFR: refrigerant flow rate
RA: refrigerating ability
HRC : heat required for condensation As shown in Table 1, the refrigerating ability of the refrigerator when it is operated at an evaporating temperature of −28° C. is increased by 1.8 times in comparison with that of the refrigerator when it is operated at the evaporating temperature of −15° C. Therefore, to carry out a sufficient heat exchange, the size of the evaporator must be increased, but the size limit of the refrigerator prevents the size of the evaporator from being increased without limit.

SUMMARY OF THE INVENTION

Accordingly, it is an object of the present invention to provide an improved refrigerant circulation apparatus in which two evaporators utilizing different evaporating temperatures are employed which is capable of the efficient refrigerant circulation without changing the size of an evaporator and a condenser.

To achieve the above object, there is provided an improved refrigerant circulation apparatus utilizing two evaporating temperatures which includes a compressor, a condenser, a plurality of evaporators having respectively different evaporating temperatures, a plurality of refrigerant pipes for guiding a refrigerant discharged from the condenser to the plurality of evaporators, and a heat exchanging unit for guiding the refrigerant discharged from the plurality of evaporators to the compressor, including an additional plurality of refrigerant pipes portions of which are in contact with the plurality of refrigerant pipes guiding the refrigerant from the condenser to the evaporators and performing a heat exchange at contact portions thereof between high temperature refrigerant discharged from the condenser and low temperature refrigerant discharged from the evaporators.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The refrigerant circulation apparatus utilizing two evaporators having different evaporating temperatures according to the present invention will now be described in detail, referring to the accompanying drawings.

First, in the following description, an evaporator disposed in the refrigerating chamber and having high evaporating temperature & pressure is called a high temperature evaporator and an evaporator disposed in the freezing chamber and having a low evaporating temperature & pressure is called a low temperature evaporator.

Figure 3:
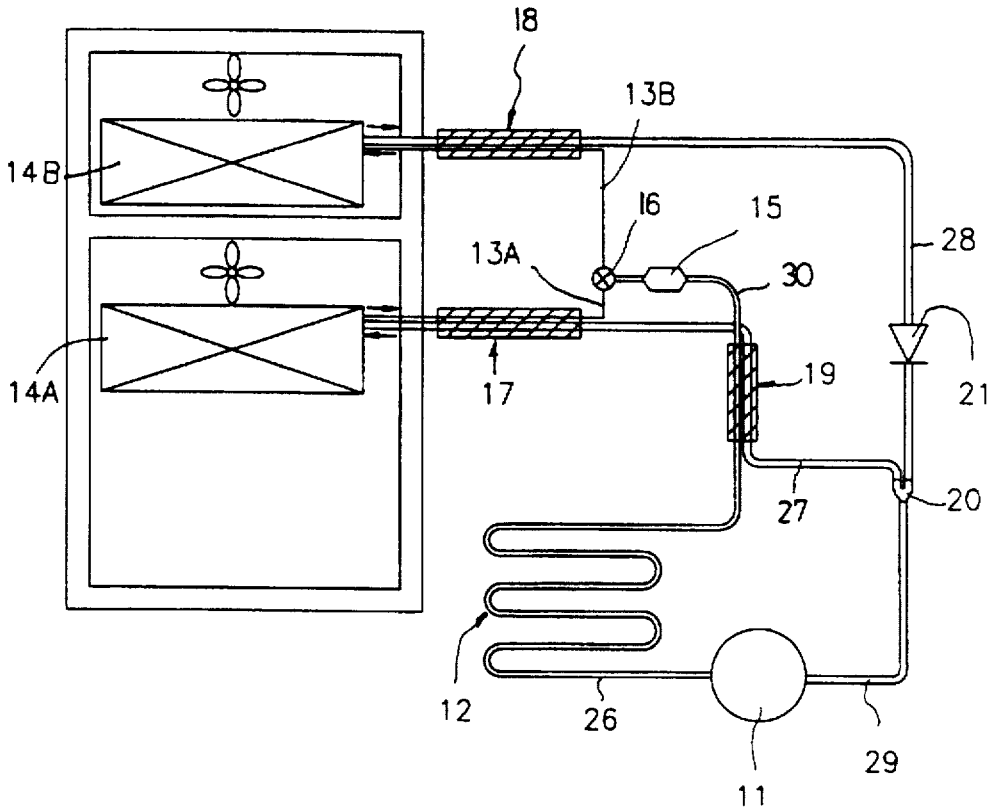
FIG. 3 is a schematic view showing a refrigerant circulation apparatus utilizing two evaporators having respectively different evaporating temperatures according to the present invention.

In the refrigerant circulation apparatus utilizing two evaporators having differing evaporating temperatures, a compressor 11 and a condenser 12 are connected by a first refrigerant pipe 26, as shown in FIG. 3.

One end of the condenser 12 is connected to a drier 15 by a second refrigerant pipe 30, and at one side of the drier 15 is provided a cross valve 16 (three-directional valve) for controlling the flowing of the refrigerant which has passed through the drier 15 in two directions.

At each side of the cross valve 16 connected to the drier 15 are connected first and second capillaries **13*a* and 13*b***.

Here, the first capillary **13*a* is connected to a high temperature evaporator 14*a* mounted in the refrigerating chamber, and the second capillary 13*b* to a low temperature evaporator 14*b*** mounted in the freezer compartment.

To the high temperature evaporator **14*a* and the low temperature evaporator 14*b* are respectively connected third and fourth refrigerant pipes 27,28 which are in parallel contact with peripheral surfaces of the first and second capillaries 13*a*,13*b*, and the pipes 27,28 are connected to a fifth refrigerant pipe 29 connected to the other side of the compressor 11**.

Here, predetermined portions among some portions of the third and fourth refrigerant pipes 27,28 connected to the high temperature evaporator **14*a* and the low temperature evaporator 14*b* are in parallel contact with the peripheral surfaces of the first and second capillaries 13*a*,13*b* to form first and second heat exchangers 17,18**.

The second refrigerant pipe 30 connecting the condenser 12 and the drier 15 is in parallel contact with a predetermined portion of the third refrigerant pipe 27 to form a third heat exchanger 19.

The third refrigerant pipe 27 connecting the high temperature evaporator **14*a* and the compressor 11 and the fourth refrigerant pipe 28 connecting the low temperature evaporator 14*b* and the compressor 11 are joined before they are connected to the compressor 11 to be connected to the fifth refrigerant pipe 29 by a Y-shaped junction pipe 20**.

Here, in the fourth refrigerant pipe 28 connecting the low temperature evaporator **14*b* and the Y-shaped pipe 20 is provided a unidirectional valve 21 to permit the flowing of the refrigerant only towards the compressor 11** for the purpose of preventing the counterflow of the refrigerant.

The unidirectional valve 21 is preferably a check valve.

That is, in the refrigerant circulation apparatus with two evaporators having different evaporating temperatures, namely the high temperature evaporator **14*a* and the low temperature evaporator 14*b*, the refrigerant pipes 13*a*,13*b*, 30 for guiding the refrigerant discharged from the condenser 12 to the evaporators 14*a*,14*b* and the refrigerant pipes 27,28 for guiding the refrigerant discharged from the evaporators 14*a*,14*b* to the compressor 11 are respectively arranged in contact with one another to form a heat exchanger for performing a heat exchange between the high temperature refrigerant discharged from the condenser 12 and the low temperature refrigerant discharged from the evaporator 14*a*, 14*b***.

The operation and effect of the refrigerant circulation apparatus utilizing two evaporators having different evaporating temperatures according to the present invention will now be described in detail.

In the refrigerant circulation apparatus according to the present invention, high temperature and pressure refrigerant gas discharged from the compressor 11 passes through the condenser 12 and the drier 15 through the refrigerant pipes 26,30, and then is selectively routed by the cross valve 16 to be introduced to the high temperature evaporator **14*a* through the first capillary 13*a*, or to the low temperature evaporator 14*b* through the second capillary 13*b*. Then the evaporated refrigerant is again introduced to the compressor 11 through the refrigerant pipes 27 or 28**.

Described in more detail, in the above case, when the refrigerant passes through the cross valve 16 and then flows through the first capillary **13*a*, the refrigerant is introduced to the high temperature evaporator 14*a* and the low temperature and pressure refrigerant discharged from the high temperature evaporator 14*a* is introduced to the compressor 11. The heat exchange of the refrigerant is carried out through the first and third heat exchangers 17,19, and the residual amount of heat is given off radiantly in the condenser 12**.

When the refrigerant passes through the cross valve 16 and is sent to the second capillary **13*b*, the refrigerant is introduced to the low temperature evaporator 14*b*, and the low temperature and pressure refrigerant discharged from the low temperature evaporator 14*b* is sent to the compressor 11. The heat exchange of the refrigerant is performed through the second heat exchanger 18, and the residual amount of heat is given off in the condenser 12**.

Figure 1:
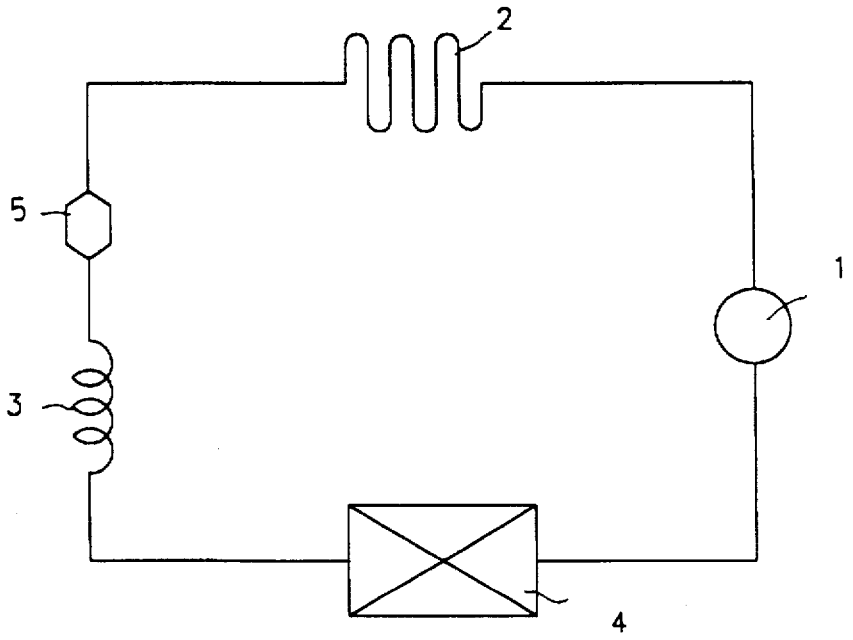
FIG. 1 CONVENTIONAL ART
FIG. 1 is a schematic view showing a refrigerant circulation apparatus according to the conventional art.
Figure 2:
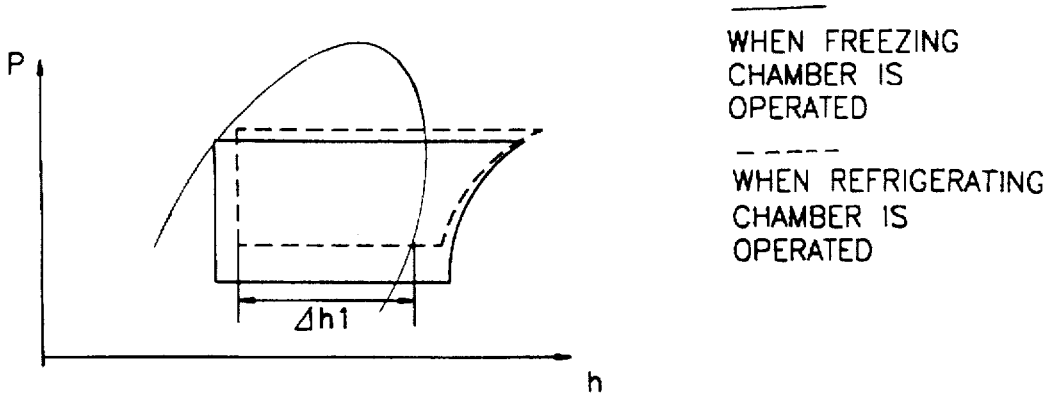
FIG. 2 CONVENTIONAL ART
FIG. 2 is a press-heat(p-h) chart of a refrigerant circulation apparatus according to the conventional art.
Figure 4:
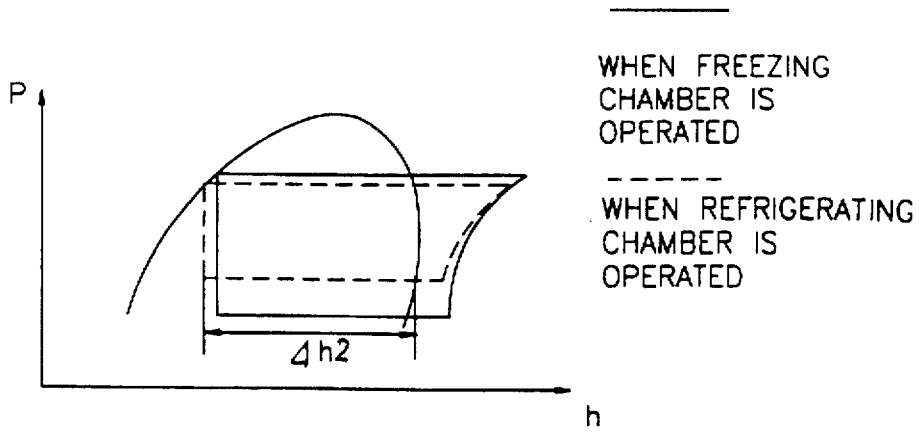
FIG. 4 is a p-h chart of a refrigerant circulation apparatus utilizing two evaporating temperatures according to the present invention.

Accordingly, in the refrigerant circulation apparatus utilizing two evaporators having different evaporating temperatures according to the present invention, through the above procedure, as shown in FIG. 4, in comparison with the p-h chart shown in FIG. 2 according to the conventional art, the condensing temperature and pressure of the refrigerant are lowered, the effective refrigerating ability ($\Delta h2>\Delta h1$) of the evaporators 14*a*,14*b* is increased and the compression ratio is lowered, and as a result the efficiency of the compressor 11 is enhanced.

In the refrigerant circulation apparatus according to the present invention, the heat exchange of the refrigerant returning to the compressor is performed by the heat exchanger, and the residual amount of heat is exchanged in the condenser, and thereby the condensing pressure is lowered by a small-sized evaporator and the condenser to provide efficient refrigerant circulation, and an evaporating temperature is increased although an identical-sized evaporator to the conventional art is employed, resulting in achieving the efficiency of the refrigerant circulation.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A refrigerant circulation apparatus utilizing plural evaporators having different respective evaporating temperatures, comprising:

a compressor;

a condenser;

a plurality of evaporators which are connected in parallel and which have respectively different evaporating temperatures;

a plurality of refrigerant pipes for guiding a refrigerant discharged from the condenser to the plurality of evaporators; and a heat exchanging means for guiding the refrigerant discharged from the plurality of evaporators to the compressor, including an additional plurality of refrigerant pipes, portions of which are in contact with the plurality of refrigerant pipes which guide the refrigerant from the condenser to the evaporators and exchange heat at contact portions thereof between high temperature refrigerant discharged from the condenser and low temperature refrigerant discharged from the evaporators;

wherein the heat exchanging means comprises:

a first heat exchanger formed by a portion of one of said refrigerant pipes guiding the refrigerant discharged from one of the evaporators operating at a high evaporating temperature and pressure among the plurality of evaporators to the compressor being in contact with a first capillary branched from one of the plurality of refrigerant pipes guiding the refrigerant from the condenser to the evaporator at a high evaporating temperature and pressure;

a second heat exchanger formed by a portion of one of said refrigerant pipes guiding the refrigerant discharged from one of the evaporators operating at a low evaporating temperature and pressure among the plurality of evaporators to the compressor being in contact with a second capillary branched from one of the plurality of refrigerant pipes guiding the refrigerant to the condenser to the evaporator at a low evaporating temperature and pressure; and a third heat exchanger formed by a portion of one of the plurality of refrigerant pipes guiding refrigerant from the condenser to the plurality of evaporators being in contact with the refrigerant pipe guiding refrigerant from the evaporator operating at a high evaporating temperature and pressure through the first heat exchanger to the compressor.

2. The apparatus of claim 1, wherein a unidirectional valve for preventing the counterflow of the refrigerant is provided in the refrigerant pipe guiding the refrigerant discharged from the evaporator operating at a low evaporating temperature and pressure to the compressor.

3. The apparatus of claim 2, wherein the unidirectional valve is a check valve.

* * * * *